US005370384A

United States Patent [19]

Romanowski

[11] Patent Number: 5,370,384

[45] Date of Patent: Dec. 6, 1994

[54] SHEET TRANSPORT BELT AND SUPPORT SYSTEM FOR A SORTER OR MAILBOX

[75] Inventor: Robert F. Romanowski, Rochester, N.Y.

[73] Assignee: Xerox Corporation, Stamford, Conn.

[21] Appl. No.: 193,593

[22] Filed: Feb. 8, 1994

[51] Int. Cl.[5] ..... B65H 39/10

[52] U.S. Cl. ..... 271/297; 474/264; 198/847; 271/198

[58] Field of Search ..... 474/143, 264, 268, 271; 271/275, 296, 297, 305, 198, 292; 198/846, 847, 688.1

[56] References Cited

U.S. PATENT DOCUMENTS

| | | | |
|---|---|---|---|
| 1,855,808 | 4/1932 | Schwan | 198/847 |
| 3,311,369 | 3/1967 | Pitt | 271/198 |
| 3,709,480 | 1/1973 | Schulze et al. | 271/297 |
| 4,244,234 | 1/1981 | Standley | 474/264 |
| 4,318,542 | 3/1982 | Altmann et al. | 271/297 |
| 4,378,110 | 3/1983 | Green et al. | 271/297 |
| 4,470,591 | 9/1984 | Acquaviva | 271/245 |
| 4,501,419 | 2/1985 | Takahashi et al. | 271/288 |
| 4,790,799 | 12/1988 | Sadler | 474/268 |
| 5,267,729 | 12/1993 | Hirota et al. | 271/198 |
| 5,288,062 | 2/1994 | Rizzolo et al. | 270/53 |
| 5,308,058 | 5/1994 | Mandel et al. | 271/297 |
| 5,328,169 | 7/1994 | Mandel | 271/290 |

FOREIGN PATENT DOCUMENTS

| | | | |
|---|---|---|---|
| 62368 | 3/1990 | Japan | 271/305 |
| 403288743 | 12/1991 | Japan | 271/198 |
| 405069978 | 3/1993 | Japan | 271/275 |

OTHER PUBLICATIONS

Xerox Disclosure Journal vol. 4, No. 4, Jul./Aug. 1979, p. 467.

*Primary Examiner*—H. Grant Skaggs

[57] ABSTRACT

A sheet transport path system for transporting reproduction sheets along an elongated sheet transport path in a multibin sorter or mailbox system is provided by elongated moving belts having a high friction sheet engaging outside belt surface and an inside belt surface driven by belt drive rollers, and a belt backing system for supporting the inside of the belt flight. A low friction endless band centrally of the inside belt surface is engaged by the belt backing system. The belt backing system is an elongated fixed skid plate system narrower than the low friction endless band, and sliding thereagainst. High friction areas on the inside belt surface on opposite sides of this low friction endless band engage the belt drive roller for non-slip driving of the belt. The belt drive roller may, if desired, have a reduced diameter central groove so as to insure only engaging these outer edge areas of the inside surface of the belt if a thick inner belt surface or thick separate inner belt is utilized.

9 Claims, 5 Drawing Sheets

SHEET TRANSPORT BELT AND SUPPORT SYSTEM FOR A SORTER OR MAILBOX

Cross-reference and incorporation by reference is made to a commonly assigned co-pending application, by Barry P. Mandel, Charles F. Prevost, Charles D. Rizzolo, Frederick H. Green, and Richard A. VanDongen, entitled "Integrated Job Mailboxing and Sets Stacking System" and which is U.S. Ser. No. 08/161615. Also, U.S. application No. 08/054,943 entitled "Mailbox/Compiler Architecture", now U.S. Pat. No. 5,342,034 by Barry P. Mandel and Richard A. VanDongen, filed Apr. 27, 1993, application No. 08/054,502, now U.S. Pat. No. 5,358,238 ; application No. 08/067,494, now U.S. Pat. No. 5,328,169; and application No. 08/057,069, now U.S. Pat. No. 5,328,169.

There is disclosed herein an improved simpler and lower cost sheet transport, utilizing a novel sheet transport belt and support system. Although also applicable to other sheet transport applications, as disclosed in the embodiments herein this improved sheet transport is particularly suited to provide an improved sheet transport for a multibin sheet sorting system, which may be a mailboxing sheet sorting system for automatically separating different jobs for different users or addressees from a printer or other reproduction apparatus into multiple sorter or mailbox bins with an improved paper path. Most sorters and mailbox systems require particularly long paper paths, in order to sequentially transport sheets past all of the desired multiple bins or trays, since the sheet may be taken from such an elongated transport into any one or more of these bins, i e, variably selectively deflected from the elongated transport path for stacking into a particular bin or bins. Thus, the sheet transports of such multibin sorters, collators or mailbox systems present particular design and cost problems.

Takahashi, et al, U.S. Pat. No. 4,501,419 is of interest as showing individual pivotal bin gates, which gates also have another surface normally providing a "ski" or baffle for holding sheets against the sorter transport belt as they move past the array of bins until they reach the selected bin (see especially FIG. 3 thereof). Note, however, that this is on the sheet transporting side of the belt.

For mailboxing, fixed bins systems (requiring longer paper paths) are preferable to moving bins type sorters. Moving bin sorters are not desirable for mailbox systems for bin unloading operability reasons. They are unlike sorter systems, which hold only plural sets of one single users job, and stop after set completion. A mailbox system holds many different users jobs in different bins and can start up at any time, including times while other bins are being unloaded. If the bins of a mailbox system started to move when someone was unloading their job, it could be disturbing to the user. Furthermore, since moving bin systems typically collapse the bins as they move past the sheet input location, that could pinch the users hand. Also, although moving bins systems can have shorter sheet transport paths, they have difficulty moving the bin array fast enough to provide rapid random access to any bin rather than just sequential adjacent bin access. Large multiple fixed bin sorters have other advantages over moving bin sorters, such as not requiring a high powered elevator motor to rapidly vertically move the weight of all bins when they are all filled with stacked sheets, and not having external exposed moving components. However, most fixed bin sorters and mailbox systems require particularly long paper paths, in order to sequentially transport sheets past all of the desired multiple bins or trays, since the sheet may be taken from such an elongated transport into any one or more of these bins, i.e., variably selectively deflected from the elongated transport path for stacking into a particular bin or bins. Thus, the sheet transports of such multibin sorters, collators or mailbox systems present particular design and cost problems. However, as noted, fixed bins sorter or mailbox systems require long sheet transport paths, typically provided by plural parallel elongated frictional sheet transporting belts, all supported along at least one side, although a single elongate central belt can be utilized in some Cases.

As compared to the prior art sheet transport belt and support systems which are schematically illustrated herein for ease of comparison in FIGS. 2 and 3, the exemplary sheet transport belt and support system disclosed herein reduces driving torque and thus power requirements and/or reduces requirements for supporting idlers rollers and associated such hardware components. Traditional such flat belt paper drive systems have high friction on both the inner and outer surfaces of the belt(s) to ensure a high drive force between the belt(s) and the paper and also between the belt(s) and the drive rollers for the belt(s). A principal drawback of such belt sheet transport systems is that the drag between the inner surface of the belt and the belt supporting or backing surface(s)is high if skids or other such fixed slide surfaces are used for such belt supporting or backing surface(s), as in the FIG. 2 prior art example here. That high belt drag may require either a larger belt drive motor and/or higher belt tension to prevent belt slip relative to the belt driving rollers. The prior art alternative, as shown in the FIG. 3 example, is the expense of adding multiple belt supporting or backing idler rollers to reduce drag. That of course also requires multiple idler shaft and mounting hardware for these belt supporting idlers, spaced along the entire operating run or bight of the belt(s), which can be quite expensive. The belt backing idlers operation may also increase overall noise, especially if these idlers require lubrication and/or become contaminated, such as by paper lint or the like. Another type of prior art belt transport system utilizes vacuum belts, but that requires a vacuum system with plenums, manifolds, blowers, additional power consumption, and noise problems.

The transport belt and supporting system disclosed herein substantially reduces the drag on the belt drive system without requiring such multiple idlers and enables a much simpler and lower cost belt supporting system. Here, there is provided a low power, low drag, elongated paper transporting system, yet both a high belt driving friction and a high paper drive friction to resist paper slip or skew during its long transport path.

A specific feature of the specific embodiment disclosed herein is to provide in a sheet transport path system for transporting reproduction sheets along an elongated sheet transport path provided by at least one elongated moving belt flight of at least one moving belt having an outside belt surface for engaging the sheets and an inside belt surface driven by at least one belt drive roller, and a belt backing system for supporting said inside surface of said belt flight, the improvement comprising a low friction endless band of a defined width centrally of said inside surface of said belt, which low friction band is engaged by said belt backing system, at least one elongated fixed skid plate of a width less than said defined width of said low friction endless band, said skid plate being positioned to slidably engage said low friction band to provide said belt backing system, a nigh friction sheet engaging surface on said outside belt surface for engaging and transporting said reproduction sheets, and high friction areas on said inside belt surface on opposite sides of said low friction endless band engaging said belt drive roller for non-slip driving of said belt.

Further specific features disclosed herein, individually or in combination, include those wherein said belt drive roller has a reduced diameter central area so as to only engage outer edge areas of the inside surface of said belt; and/or wherein said sheet transport path is integral a sheet output module for the collection and stacking of printed media reproduction sheets received from the output of a reproduction apparatus, with multiple separate sheet collection bins in an array of said bins, said sheet transport path extending past said array of bins for transporting a sheet to a selected said bin; and/or wherein said low friction endless band is an endless belt loop of low friction material inside a substantially wider high friction belt loop; and/or wherein said belt drive roller has a recessed groove carrying said narrow low frictional belt therein; and/or wherein there are at least two sets of plural moving said belt bights and at least two corresponding sets of skid plates respectively providing said sheet transporting, and wherein said sheet transport path enters from between said two sets.

Another disclosed feature is to provide in a multibin sheet sorting system for the collection and stacking of reproduction sheets transported to selected bins by a sheet transport path system for transporting the reproduction sheets along an elongated sheet transport path provided by at least one elongated moving belt flight of at least one moving belt having an outside belt surface for engaging the sheets and an inside belt surface driven by at least one belt drive roller, and a belt backing system for supporting said inside surface of said belt flight, the improvement comprising a low friction endless band of a defined width centrally of said inside surface of said belt, which low friction band is engaged by said belt backing system, at least one elongated fixed skid plate of a width less than said defined width of said low friction endless band,said skid plate being positioned to slidably engage said low friction band to provide said belt backing system, a high friction sheet engaging surface on said outside belt surface for engaging and transporting said reproduction sheets, and high friction areas on said inside belt surface on opposite sides of said low friction endless band engaging said belt drive roller for non-slip driving of said belt.

By way of background as to sheet transport belts with different coefficients of friction in general in different applications, there is noted Xerox Corporation U.S. Pat. No. 4,470,591 issued Sep. 11, 1984 to Thomas Acquaviva, and a Xerox Disclosure Journal publication Vol. 4, No. 4, July/August, 1979, pg. 467.

Further by way of background, although at least partially similar hardware and sheet transports may be employed, and the present system is applicable to both, there are differences between a job "mailboxing" system or module and a traditional sheet output sorter (also called a collator). This is explained in the above cross-referenced and other literature. As also explained, either a mailbox or a sorter may also include finishing, such as stapling, and/or overflow or stacking trays, fed from the same or additional alternative sheet paths. Some examples of patents relating to "Mailbox" units include Xerox Corporation U.S. Pat. No. 5,098,074 issued Mar. 24, 1992 to Barry P. Mandel, et al (D/88157), especially FIG. 4 and its description, and the last paragraph of the specification. U.S. Pat. No. 4,691,914 issued Sep. 8, 1987 to F. J. Lawrence (Gradco Systems, Inc.) discloses a random plural bin access [with plural solenoids] sheet receiver with sheet input from both the right or left sides, indicated as from a copier and a printer respectively. Grad co Systems, Inc. U.S. Pat. No. 4,843,434 filed Nov. 17, 1987 and issued Jun. 27, 1989 to F. Lawrence et al. has a brief discussion of "mailboxing" for electronic or laser printers in Col. 1, lines 28 et al., noting in particular there that: "mailboxing is more difficult, because the documents or jobs destined for different mailboxes may not and most likely will not be processed in sequence. Thus, mailboxing requires random access or positioning of the sheet feed for delivery to a selected bin or mailbox." [Col. 1 lines 37–42]. This specification then goes on to indicate that rapid bin movement is a problem for that in the prior art sorters, and that high speed job separation and ease of random access operation is desired. Of further "mailbox" interest is Seiko Epson Corporation U.S. Pat. No. 5,141,222 issued Aug. 25, 1992 by Shigeru Sawada, et al., (and its equivalent EPO Application No. 0 399 565, "Printer", published Nov. 28, 1990).

As to usable specific or alternative hardware components of the subject apparatus, it will be appreciated that, as is normally the case, some such specific hardware components are known per se in other apparatus or applications. For example, various commercially available stand-alone, self-controlled modular sorter units are known for sorting the output of xerographic copiers or printers, with various hardware systems. Examples include above-cited art and its references. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the example below, as well as the claims. Thus, the present invention will be better understood from this description of one embodiment thereof, including the drawing figures (approximately to scale) wherein:

Figure 1:
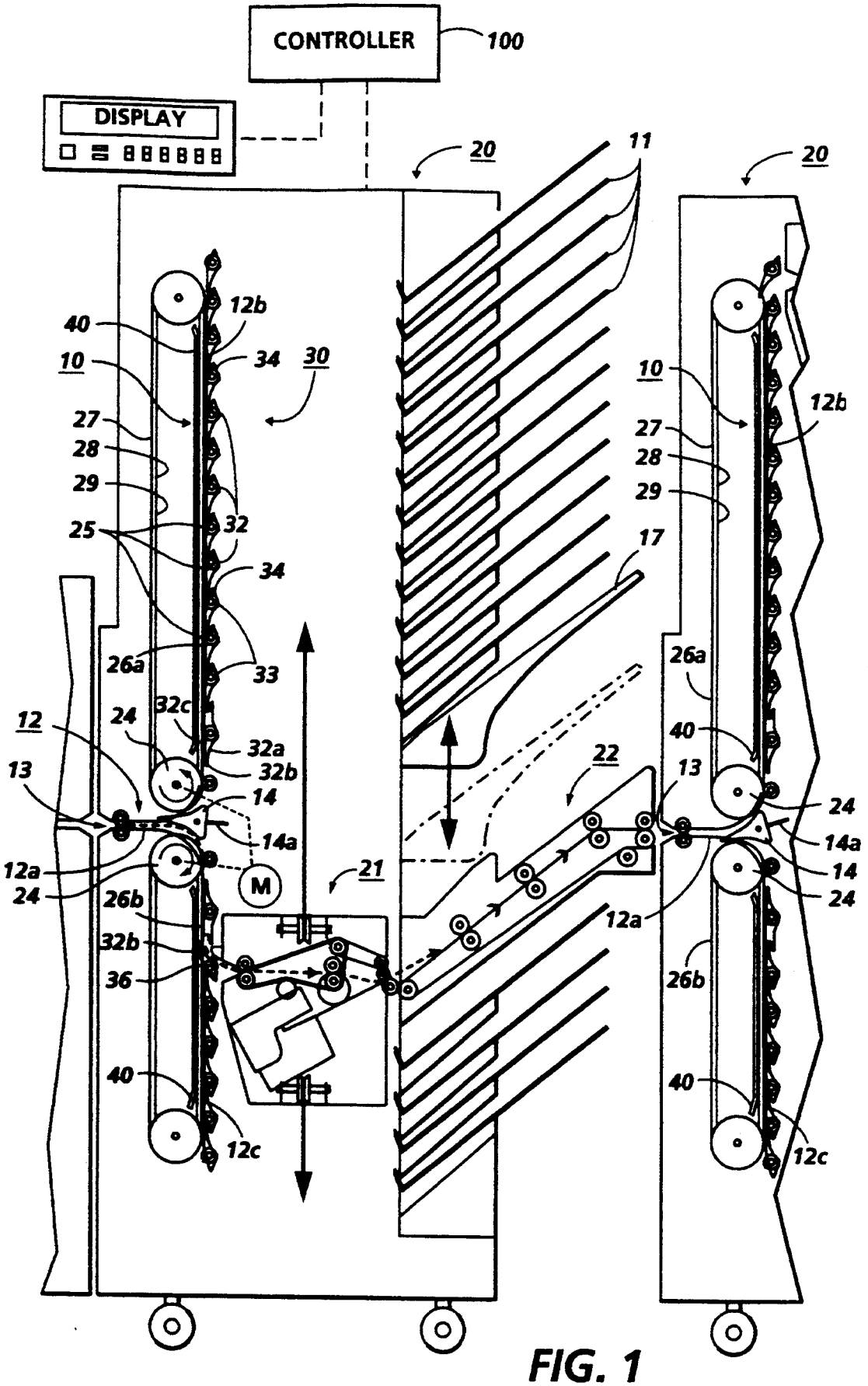
FIG. 1 is a schematic frontal view of one embodiment of a sheet transport system with belts and supports in accordance with the present invention shown in use in an exemplary mailbox/finisher/stacker module.
Figure 2:
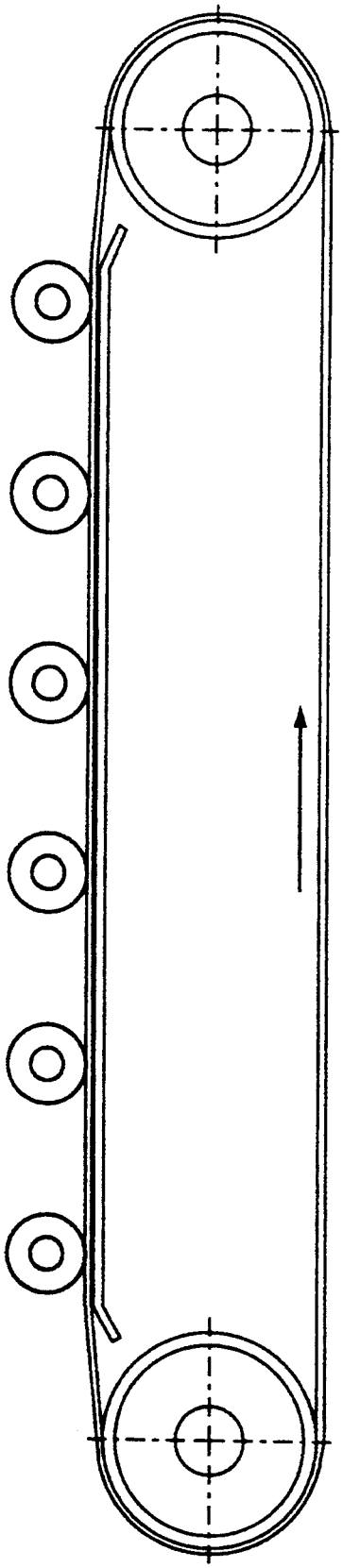
FIG. 2 PRIOR ART
FIG. 2 is a schematic frontal view of a first prior art belt sheet transport system for a sorter, with a supporting skid plate, illustrated for comparative convenience and labeled "prior art"

Turning first to the exemplary embodiment 10 of a belt sheet transport system, it is illustrated in FIG. 1 in an integrated stacker and multibin mailbox (or sorter) unit 20. It will be appreciated that this multibin output unit 20 is merely one example of one application of the sheet belt transport system 10. A printer to which this mailbox system 20 may be operatively connected is only partially shown at the far left, for its output, since any of various printers may be so connected to this unit 20, with little or no printer modifications. The illustrated mailbox bins, compiler/stapler, etc. illustrated or described herein are also exemplary, and may individually vary considerably. Thus, they need not be described in detail herein. The general reference number 11 will be used here for any individual mailbox (or sorter) tray or bin.

The specific example illustrated in FIG. 1 is a twenty bin mailbox/finisher/stacker module 20. It has a sheet path 12 utilizing one example of the subject belt sheet transport system 10. The sheet path 12 in this example fed sheets entering the unit 20 at a central or intermediate sheet entrance 13 level at one side thereof. The sheets are fed into a common path portion **12*a*, and then into one of two split path vertical sheet transports 12*b* or 12*c* respectively branching up or down, as selected by a gate 14. This preferred example thus differs from a conventional sorter or mailbox wherein there would be there a single elongate vertical belt(s) sheet transport entered from its top or bottom instead of these two vertical sheet transports 12*b* and 12*c* here entered centrally from in between the two. The vertical array of bins 11 here are in two sets, vertically spaced apart. The respective vertical sheet transports 12*b* and 12*c* run past all the bin 11** entrances of these two respective vertical bin arrays.

The sheet transports **12*b* and 12*c* here in this example are provided by identical frictional sheet transporting belts 26 in accordance with the system 10. Here, there is respectively one set of endless central belts 26*a* for upper path portion 12*b* and another belt set 26*b* for lower path portion 12*c*. The belts 26 are driven by drive rollers or pulleys 24, conventionally driven by a motor "M" shown schematically in FIG. 1. The sheet being fed is nipped against the front sides 27 of these belts 26*a*, 26*b* by belt rollers 25. The backside 28 of each belt here has a central low friction area 29 extending in an endless stripe or strip, by which the belt 26 is rear supported here by skid plates 40. (Without such rear support, the rollers 25 would simply deflect the belt.) This low friction area 29** can be a coated area or layer fastened to the inside of a conventional belt, or a separate inside belt. Both are illustrated in examples herein.

Figure 3:
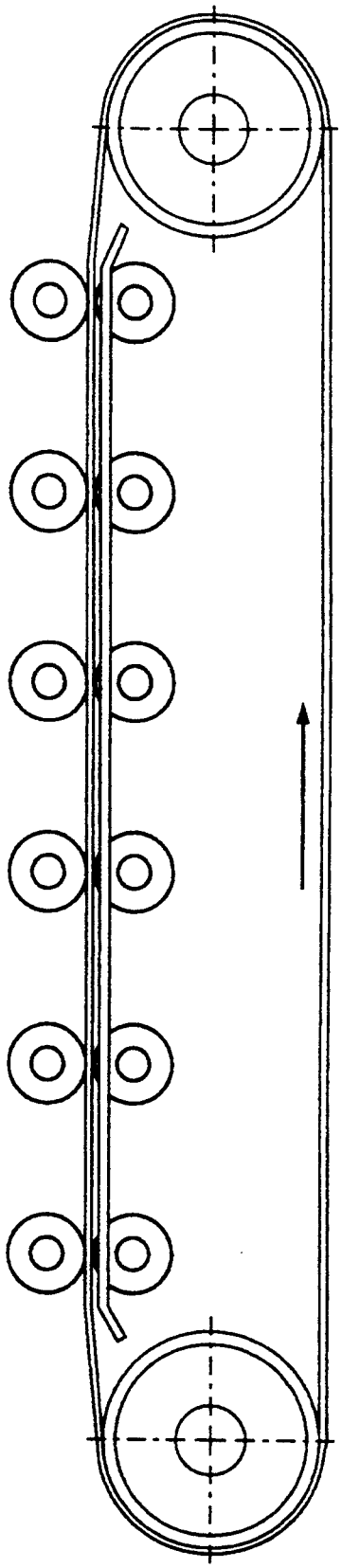
FIG. 3 PRIOR ART
FIG. 3 is a similar schematic frontal view of a second prior art belt sheet transport system for a sorter, but with multiple supporting idler rollers, also illustrated for comparative convenience and labeled "prior art"
Figure 6:
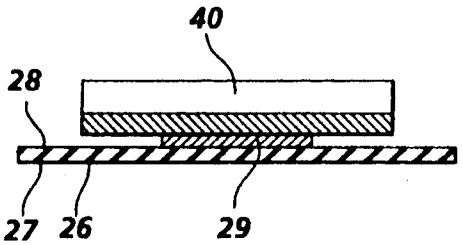
FIG. 6 is a top cross-sectional view taken along line 6—6 of FIG. 4.

In these disclosed embodiments, or any other sorter or mailbox with such belt transports, drag is greatly reduced on the drive belt system, and thus on drive Motor M. Thus, the belts 26 may be supported by sliding over simple fixed position elongate skid plates such as 40. These skid plates 40 function as the belt backers to support the transport drive of the copy sheets by the belts here, i.e., to provide the engagement normal force between the elongate belt transporting flight and the sheets on that belt flight. The belts would otherwise normally need to be supported therealong with more costly and unreliable multiple belt backing idler rollers, as in FIG. 3.

This low friction belt backing is accomplished here by providing the narrow band 29 extending along the center of the inside 28 of each drive belt 26. This band 29 has a low surface friction coefficient. This narrow central low friction band 29 is the only area of the belts 26 which is engaged and supported by the skid plate 40. A separate band 29 is illustrated, although it could alternatively be integrally bonded or coated to the interior of belt 26. However, the normal high friction is maintained on the rest of the belt 26 surfaces, that is, on both the outer surface 27 and the remainder of the inner surface 28. The high friction on the outer surface 27 of the belts 26 drives the sheets, as before. The high friction areas along the remaining high friction outside edges of the inner surface 28 of the belt 26 enables the engaging belt drive pulleys 24 to still drive the belt.

Figure 9:
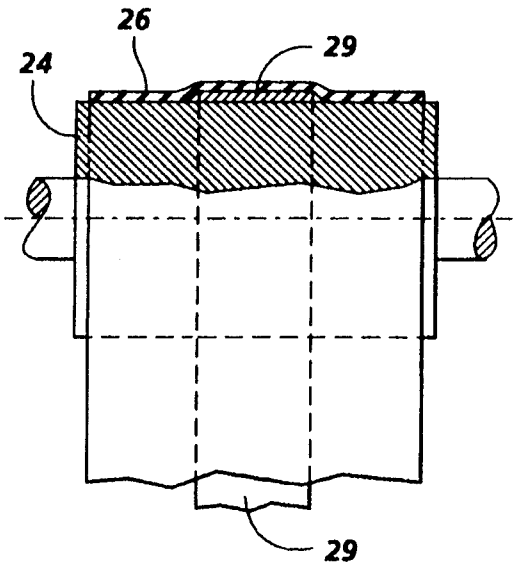
FIG. 9 is a partial cross-sectional view of one embodiment of the belt drive area.
Figure 5:
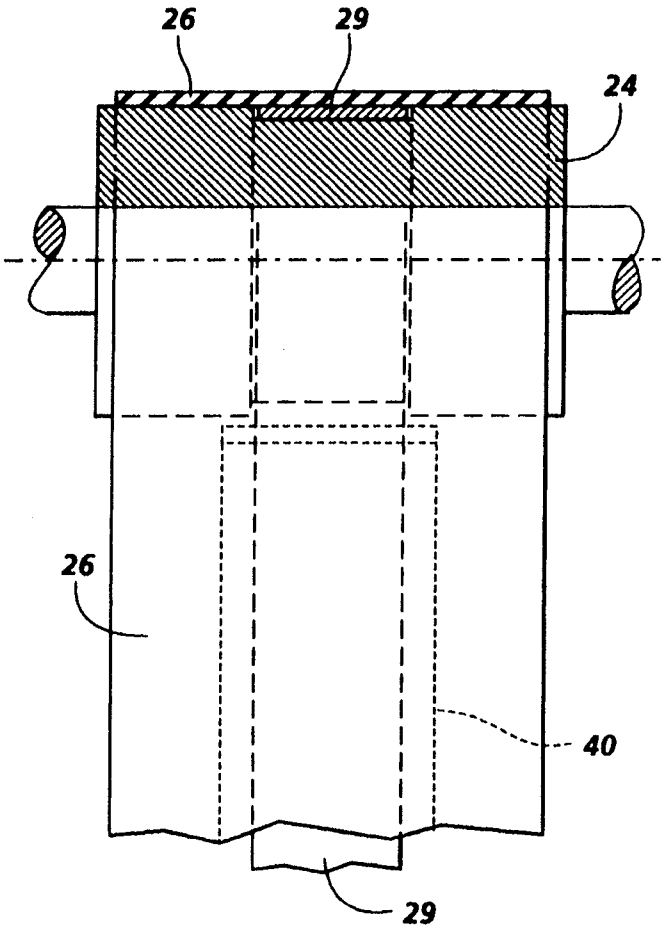
FIG. 5 is a partially cross-sectioned (along line 5—5) partial side view of the belt supporting system of FIG. 4.
Figure 4:
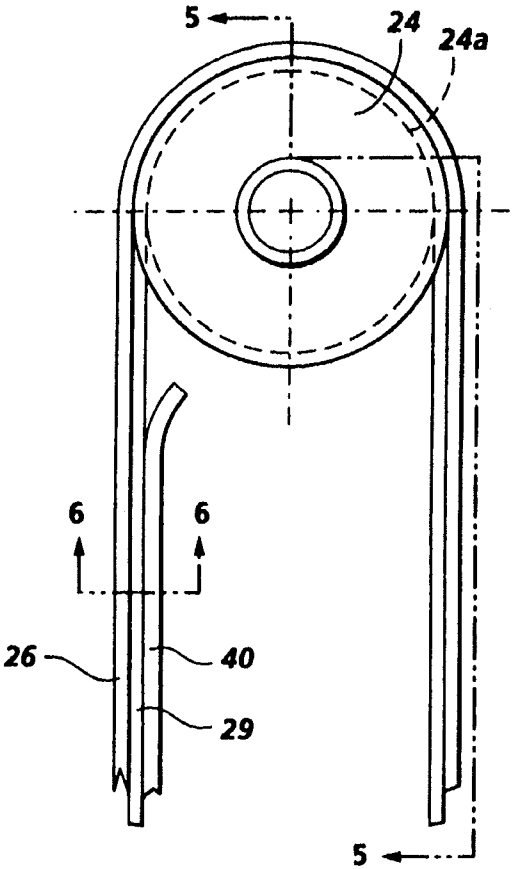
FIG. 4 is a more detailed and enlarged partial side view of a belt supporting system for the sheet transport system of FIG. 1.

As shown in FIGS. 4, 5, 6, 7, 8, and 10 (but not FIGS. 1 and 9) the pulleys 24 may, if desired, also have a reduced diameter central grooved area **24*a* for relief for the low friction belt area 27, to insure that direct engagement is only with the outer edges of the belt. If, however, the low friction inner layer of band or inner belt 29 is in the order of about 0.1 mm to 0.15 mm or less, then, as shown for example in FIG. 9 (exaggerated for clarity), no groove 24*a* is needed in drive roller 24. The small deformation of belts 26 over band 29 will not prevent good non-slip frictional engagement of its surface 28 with rollers 24 on each side of band 29**.

The low friction central interior belt loop surface 29 results in an overall torque reduction to the drive system compared to traditional flat belt paper transports even though this belt is sliding, rather than rolling, over skid plates 40. The belt engaging surface of the supporting skid plates 40 may also be coated with a low friction material, such as "TEFLON ©". In all these embodiments it will be appreciated that at least two such belt/skid plate systems are spaced apart in parallel across the sheet path, although only one of each is illustrated here.

Figure 7:
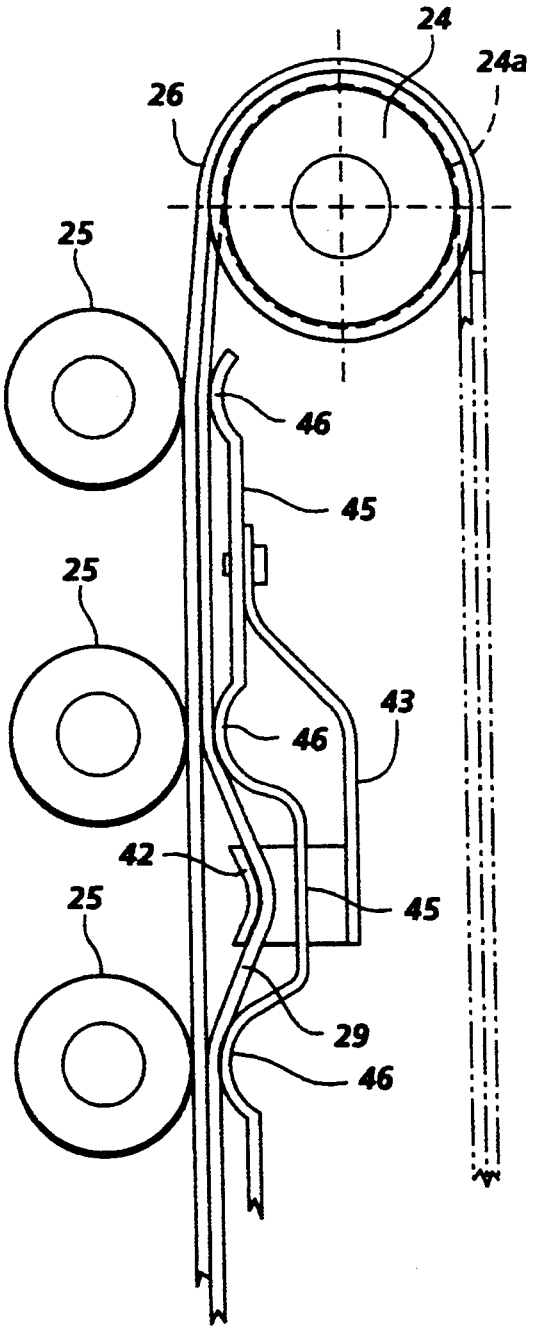
FIG. 7 shows a partial front view of another alternative embodiment of the belt supporting system of FIGS. 4–6.
Figure 8:
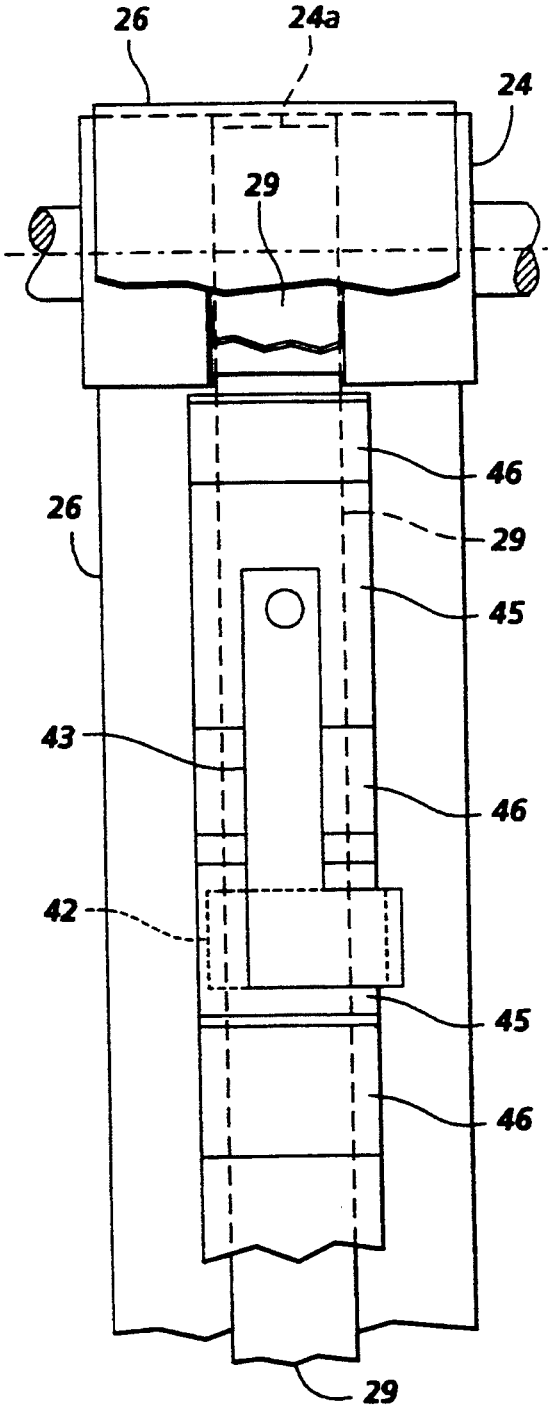
FIG. 8 is a partial side view of the embodiment of FIG. 7, with the return belt flight broken away for clarity (as in FIG. 5)
Figure 10:
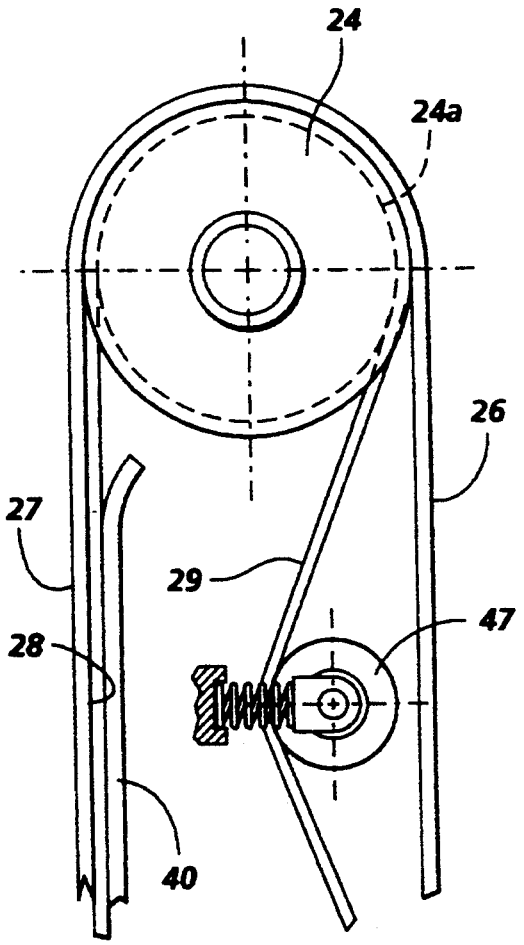
FIG. 10 shows an end view of another alternative belt tensioning system.

Different variations of this concept are shown herein. Shown in FIGS. 7 and 8 is an alternative embodiment, with a separate low friction internal belt 29 inside the main feed belt, but with different (separate) tensioning means, such as a guide or spring bracket 42, which may be tensioned by integral springs 43 for belt 29 only. As is also shown there, a different form of skid plate 45 may also be provided, with spaced, arcuate, belt contact areas 46 engaging the inside of belt 29 (and thus indirectly supporting the overlaying belt 26 interior) only in the areas opposite from rollers 25. Shown in FIG. 10 is a separate spring loaded idler roller 47 for low friction band 29, where band 29 is not elastic, and thus needs different tensioning than the frictional belt 26.

Another optional disclosed feature in FIG. 1 is a high capacity (elevator) output tray 17 is located near the center of the mailbox bins array in the vertical space between the two sets of bins. This tray 17 location relative to the sheet path **12*a* and its entrance 13, yields optimum unload height for the high capacity tray 17** and also minimum first copy output time for such copying jobs (e.g. from multifunction machines).

The central sheet path deflector gate 14 may be switched or actuated here into either an up or down position to select between transports 12b or 12c simply by the motion of a finishing carriage 21. Therefore, this gate 14 requires no additional electronics or logic.

Although a finisher unit 21 is shown here, it is not required, and similar advantages here can be provided in a non-finishing module. Also, this particular moving compiler/finisher unit 21 is merely exemplary.

The "T" sheet path 12 configuration 12a, 12b, 12c here results in shorter average and more reliable paper paths to the respective bins 11 as well as to the elevator stacking tray 17 (which can handle the widest array of sizes/materials), and also a shorter path to an optional central bypass transport such as 22.

This module 20 plural mode center entrance architecture of this example can provide a high capacity output tray 17 desirably located near the center of a mailbox bin vertical array, in what would otherwise be wasted space. The elevator tray system 17 conventionally moves down within this space as it fills, utilizing this space to allow high capacity stacking. This yields optimum unloading height for the high capacity tray 17, and also, on average, shorter and more reliable paper paths, especially to the elevator stacker 17, which must handle the widest array of sizes/materials, and thus benefits from the straightest possible entrance path. The central sheet entrance geometry here also enables a short bypass path such as 22 on to a second or third such mailbox unit 10 also having the same central level input 13 and central thruput path 12a. It enables a common input 13 location for all such mailbox modules, no matter where in a chain of modules and stackers they are located. An optional bypass transport 22, as shown in FIG. 1, can be substituted and used in the location of two adjacent bins 11, preferably the two bins closest to the output end of central sheet path 12a. This bypass 22 passes sheets centrally on to another unit 20 or other finishing module with conventional roller or belt feeders.

For "mailboxing" functions, the conventionally sequentially received hard copy of plural page collated documents from a pre-collation output electronic printer may be fed into the unit 20 and automatically fed to the particular bin 11 assignment destination of those job sheets by the sheet transport system 10. The mailbox unit 10 preferably directs all designated sheets of a users job to an available bin or bins 11 temporarily assigned to that printer user based on bin availability.

As noted, the disclosed unit 20 is desirably a universal stand-alone unit that is attached to, or even simply moved next to, the output of almost any conventional printer. Plural units 20 may be ganged in series, like plural sorters, if desired, for an increased number of available bins, using conventional sheet pass-through feeders and gates and/or the bypass 22 shown herein, or the like, as shown in FIG. 1. As is well known in sorting, sorter bin units can be extended or serially connected in this manner to provide more available bins. The job sorting unit 20 can take sheets inputted at its sheet input 13 from various printer outputs, including multi-functional units.

The internal sheet feeding path 12 in the mailbox unit 20 can utilize various known sorter sheet transports of various configurations, many of which are shown in cited and other art, providing the sheet path and advantages discussed above are provided. Here, in this example, once each output sheet of the printer has been acquired by the input feeder or the like of an initial common path 12a of the unit 20, the further sheet feeding may be done in path 12b or 12c by the illustrated rollers 25 engaging respective sets of belts 26a or 26b to form feed nips feeding the sheet along the belts 26 until the sheet meets a bin selection and feeding means 30 which, when activated, deflects the sheet into that selected bin 11. Here, the right hand flight or bight of the two sets of moving belts 26a and 26b respectively carries the sheet thereon upwardly in path 12b and downwardly in path 12c from the center of the unit 10 past a respective series of gates or sheet deflectors 32. The sheet is deflected into the selected bin 11 by a curved surface 32a of the gate 32 for that bin when the sheet reaches an opened gate 32 adjacent the selected bin or tray 11 entrance.

As noted, various components of the mailbox unit 10 can be conventional, even commercially available, except as controlled and modified as described herein. Various feeding and gating arrangements whereby inputted sheets are fed to and gated into selected bins by a moving gate with a positionable sheet deflector rather than by separate associated deflecting bin gates, as here, are well known in the art. The illustrated plural stationary but pivotal sheet deflectors 32 to selectably deflect sheets from the feed belts 26 into the selected bin 11 are merely exemplary.

In the illustrated mailbox sheet diversion or bin selection system 30 example of FIG. 1, plural sheet diverter gates 32 are commonly mounted in line on rotatable shafts 33 to define plural gate units 34. The number and spacing of such gates/shaft units 34 equals the number and spacing of the bins 11. They are closely parallel to, and vertically spaced along, the plural belts 26 sheet transport. The same shafts 33 may also support the sheet path idler rollers 25 forming the sheet feeding nips with that side 27 of the belts 26 as shown. However, instead of being conventionally directly adjacent the bins, (as they could be) in this example 20 the diverter gate units 34 here are horizontally separated from the bins here by the space for (width of) the vertically moving finishing carriage 21, here comprising a compiler/stapling set ejecting unit. When one set or unit 34 of the pivotal gates 32 is pivoted, the top surface 32a, including end fingers 32b of each gate 32, acts as sheet deflectors to deflect sheets off of the sheet transport belts 26 at that gate unit 34 location, and into (or through) the adjacent finishing carriage 21 which is then located at that selected bin 11 location. The controller 100 selected single line of gates 32 (one gate unit 34) may be pivoted on its shaft 33 by a solenoid or by direct mechanical engagement of a cam actuator projection on the elevator moved finishing unit 21 with one or more gate opening cam followers 36 (preferably outside the paper path) on the pivotal gate unit 34 shaft 33 for rotating that shaft. This engagement (see below) pivots the end fingers 32b of that set of gates 32 out through spaces between or on opposite sides of the vertical sheet transport belts 26 so that these fingers 32b are positioned to catch the sheets on their top surface 32a and deflect them off of the belt transport system 10 and into the compiler/finishing unit 21 (or directly into a bin). That is, the sheet deflector fingers are laterally offset from the belts 26 so that they can pivot in between the belts and their backing skid plates 40.

Meanwhile, all the other pivotal gates 32 are all gravity-loaded into a closed (vertical) position, in which their rear or left sides 32c function as sheet guides or baffles to help maintain sheets on the transport belts 26 vertical path passing thereby.

When the pulley/cable or other elevator system for the finishing carriage 21 moves that unit on to a different selected bin position, the previously opened adjacent bin gates reclose, and that other newly selected set of 34 gates 32 is pushed pivoted open. This eliminates the requirement for multiple solenoids, one for each bin, and their wiring for bin selections. That is, here there are plural, but dual mode, gates, which are individually cammed open one at a time by a moving compiler/finisher unit, which also forms part of the sheet path into the selected bin. Thus, this unit 21 here actuates, and forms part of the sheet diversion and bin selection system 30. Note that moving gate sorters (e.g., Norfin Co. Snelling, et al. U.S. Pat. No. 3,414,254) are also known in the sorter art, and could be used instead. Typically these have only a single non-pivotal gate, per se, having one set of non-pivotal deflector fingers between the bins and the frictional belt and/or vacuum sheet transport, always extending into the belts, which single gate is moved up and down past the bins by an elevator mechanism. In contrast, in this example the finishing carriage 21 is vertically moved up or down to its adjacent bin, not the gates. Various known elevator systems may be used for the unit 21 here, such as elongated screw shafts rotated by a motor at their top or bottom, or a driven cable belt and pulley system. The unit 21 can conventionally slide up and down on conventional vertical elevator rails or smooth cylindrical rods.

Note that the sheet transporting system here is not limited to the above-described example of one particular bin selection or gating system. The example of a sheet job set compiling and stapling and/or ejecting finishing system 21 herein may be similar to that disclosed and described in Xerox Corporation application Ser. No. 07/888,091, filed May 26, 1992, by Barry P. Mandel, et al, now U.S. Pat. No. 5,288,062. Another compiling and stapling system is disclosed in his above-cited U.S. Pat. No. 5,098,074.

The disclosed sheet transportation system provides improved elongate sheet transport paths especially suitable for sorters and mailbox systems at low power and cost. Here, there is provided both a high belt drive friction and high paper drive friction and yet a low drag belt transporting system. While the embodiment disclosed herein is preferred, it will be appreciated from this teaching that various alternatives, modifications, variations or improvements therein may be made by those skilled in the art, which are intended to be encompassed by the following claims:

What is claimed is:

1. In a sheet transport path system for transporting reproduction sheets along an elongated sheet transport path provided by at least one elongated moving belt flight of at least one moving belt having an outside belt surface for engaging the sheets and an inside belt surface driven by at least one belt drive roller, and a belt backing system for supporting said inside surface of said belt flight; the improvement comprising:

a low friction endless band of a defined width centrally of said inside surface of said belt, which low friction band is engaged by said belt backing system, at least one elongated fixed skid plate, said skid plate being positioned to slidably engage said low friction band to provide said belt backing system, a high friction sheet engaging surface on said outside belt surface for engaging and transporting said reproduction sheets, and high friction areas on said inside belt surface on opposite sides of said low friction endless band engaging said belt drive roller for non-slip driving of said belt.

2. The sheet transport path system of claim 1 wherein said belt drive roller has a reduced diameter central area so as to only engage outer edge areas of the inside surface of said belt.

3. The sheet transport path system of claim 1 wherein said sheet transport path is integral with a sheet output module for the collection and stacking of printed media reproduction sheets received from the output of a reproduction apparatus, with multiple separate sheet collection bins in an array of said bins, said sheet transport path extending past said array of bins for transporting a sheet to a selected said bin.

4. The sheet transport path system of claim 1 wherein said low friction endless band is an endless belt loop of low friction material inside a substantially wider high friction belt loop.

5. The sheet transport path system of claim 1 wherein said low friction endless band comprises a narrow low frictional belt mounted inside a wider high friction belt.

6. The sheet transport path system of claim 5 wherein said belt drive roller has a recessed groove Carrying said narrow low frictional belt therein.

7. The sheet transport path system of claim 1 wherein there are at least two sets of plural moving said belt flights and at least two corresponding sets of skid plates respectively providing said sheet transporting, and wherein said sheet transport path enters from between said two sets.

8. In a multibin sheet sorting system for the collection and stacking of reproduction sheets transported to selected bins by a sheet transport path system for transporting the reproduction sheets along an elongated sheet transport path provided by at least one elongated moving belt flight of at least one moving belt having an outside belt surface for engaging the sheets and an inside belt surface driven by at least one belt drive roller, and a belt backing system for supporting said inside surface of said belt flight, the improvement comprising:

a low friction endless band of a defined width centrally of said inside surface of said belt, which low friction band is engaged by said belt backing system, at least one elongated fixed skid plate, said skid plate being positioned to slidably engage said low friction band to provide said belt backing system, a high friction sheet engaging surface on said outside belt surface for engaging and transporting said reproduction sheets, and high friction areas on said inside belt surface on opposite sides of said low friction endless band engaging said belt drive roller for non-slip driving of said belt.

9. The sheet transport path system of claim 8 wherein said sheet transport path is integral with a sheet output module for the collection and stacking of printed media reproduction sheets received from the output of a reproduction apparatus, with multiple separate sheet collection bins in an array of said bins, said sheet transport path extending past said array of bins for transporting a sheet to a selected said bin.

* * * * *